US009615650B2

(12) United States Patent
Soriano et al.

(10) Patent No.: US 9,615,650 B2
(45) Date of Patent: Apr. 11, 2017

(54) ARMBAND FOR AN ELECTRONIC DEVICE

(71) Applicant: SUPERIOR COMMUNICATIONS, INC., Irwindale, CA (US)

(72) Inventors: Bryan Michael Soriano, Pomona, CA (US); Vivian Wei-Fen Chou, Diamond Bar, CA (US)

(73) Assignee: Superior Communications, Inc., Irwindale, CA (US)

( * ) Notice: Subject to any disclaimer, the term of this patent is extended or adjusted under 35 U.S.C. 154(b) by 74 days.

(21) Appl. No.: 14/558,630

(22) Filed: Dec. 2, 2014

(65) Prior Publication Data

US 2015/0150360 A1 Jun. 4, 2015

Related U.S. Application Data

(60) Provisional application No. 61/910,891, filed on Dec. 2, 2013.

(51) Int. Cl.
*A45F 5/00* (2006.01)

(52) U.S. Cl.
CPC ..... *A45F 5/00* (2013.01); *A45F 2005/008* (2013.01); *A45F 2200/0508* (2013.01); *A45F 2200/0516* (2013.01); *Y10S 224/93* (2013.01)

(58) Field of Classification Search
CPC ..... A45F 2005/008; A45F 2200/0516; A45F 2200/0508; A45F 3/12; Y10S 224/93; A45C 2011/001; A45C 2011/002; A45C 13/30
USPC ..... 224/930, 219, 221, 222, 267, 264, 643; 206/320
See application file for complete search history.

(56) References Cited

U.S. PATENT DOCUMENTS

| | | | | |
|---|---|---|---|---|
| 1,573,239 | A * | 2/1926 | Gilliland | B65D 81/18 206/0.81 |
| 3,232,685 | A * | 2/1966 | Wilstein | B42D 5/006 108/23 |
| 4,509,667 | A * | 4/1985 | Meldrum | A45F 5/00 224/222 |
| 5,213,242 | A * | 5/1993 | de Jong | A61M 37/0069 224/222 |
| 5,410,762 | A * | 5/1995 | Maskovich | A45F 5/00 2/312 |
| 5,810,220 | A * | 9/1998 | Petersen | A45F 5/00 108/43 |
| 6,179,177 | B1 * | 1/2001 | Hihara | A44C 5/145 224/164 |
| 6,526,635 | B2 * | 3/2003 | Nasu | A45F 5/02 24/17 B |

(Continued)

*Primary Examiner* — Justin Larson
(74) *Attorney, Agent, or Firm* — Snell & Wilmer LLP

(57) ABSTRACT

An armband includes an electronic device holder including an outer shell for holding an electronic device. A first wing structure with a first strap opening extends outward from the outer shell and a second wing structure with a second strap opening extends outward from the outer shell. The armband further includes a strap with at least one attachment portion located between a first end portion and a second end portion of the strap for detachably securing the first end portion after the strap has passed through the first strap opening and for detachably securing the second end portion after the strap has passed through the second strap opening. An inner layer of the strap includes a moisture wicking material.

17 Claims, 9 Drawing Sheets

(56) References Cited

U.S. PATENT DOCUMENTS

| | | | | |
|---|---|---|---|---|
| 6,698,636 | B2 * | 3/2004 | Angus | A45F 3/00 224/660 |
| D537,623 | S * | 3/2007 | Dennis | D3/218 |
| 7,356,888 | B2 * | 4/2008 | Chao | A45F 5/00 24/306 |
| 8,196,792 | B2 * | 6/2012 | Clifton, Jr. | A45F 5/00 224/661 |
| 8,204,561 | B2 * | 6/2012 | Mongan | A45C 11/00 206/592 |
| 8,474,669 | B2 * | 7/2013 | Rohrbach | A45F 5/00 224/222 |
| 8,621,724 | B2 * | 1/2014 | Honeycutt | A41D 1/002 24/129 R |
| 8,752,740 | B2 * | 6/2014 | Morgan | A45F 5/00 224/222 |
| D713,835 | S * | 9/2014 | Sirichai | D14/253 |
| D715,537 | S * | 10/2014 | Soriano | D3/218 |
| D716,040 | S * | 10/2014 | Soriano | D3/218 |
| 8,857,683 | B2 * | 10/2014 | Cameron | A45C 11/00 224/222 |
| 9,155,168 | B2 * | 10/2015 | Araujo | F21V 23/0492 |
| 2009/0108039 | A1 * | 4/2009 | Sherman | A45F 5/00 224/577 |
| 2010/0327030 | A1 * | 12/2010 | Yang | A45F 5/00 224/199 |
| 2011/0253571 | A1 * | 10/2011 | Rothbaum | B65D 63/10 206/320 |
| 2012/0074184 | A1 * | 3/2012 | Morgan | A45F 5/00 224/222 |
| 2014/0326774 | A1 * | 11/2014 | Coleman | H04B 1/385 224/601 |

* cited by examiner

ARMBAND FOR AN ELECTRONIC DEVICE

CROSS-REFERENCE TO RELATED APPLICATION

This application claims the benefit and priority of U.S. Provisional Application No. 61/910,891, filed on Dec. 2, 2013, which is hereby incorporated by reference in its entirety.

FIELD

The present invention relates to armbands for holding and securing an electronic device to an individual's arm, and more particularly, to an armband with a removable electronic device holder.

BACKGROUND

Many armbands are currently available for securing an electronic device such as a smart phone to an arm. However, these armbands can be difficult to put on and take off and may require several different sizes to properly fit different sized arms. Also, conventional armbands generally do not have good moisture control properties. Accordingly, there is a need for an armband that is easy to use, has moisture control, and allows for better adjustment to a variety of different arm sizes.

SUMMARY

In view of the foregoing deficiencies of conventional armbands, the present disclosure concerns an armband with an electronic device holder and a strap. According to one embodiment, the armband includes an outer shell for holding an electronic device. A first wing structure of the armband is connected to the outer shell and extends outward from the outer shell. The first wing structure includes a first strap opening. In addition, a second wing structure with a second strap opening is connected to the outer shell and extends outward from the outer shell. The armband further includes a strap including a first end portion for insertion into the first strap opening and a second end portion opposite the first end portion. At least one attachment portion is located between the first end portion and the second end portion of the strap for detachably securing the first end portion to the at least one attachment portion after the strap has passed through the first strap opening and for detachably securing the second end portion after the strap has passed through the second strap opening.

By virtue of the foregoing arrangement of the strap with the first strap opening and the second strap opening, it is ordinarily possible to adjust the fit of the strap from either the first end portion or the second end portion of the strap. This flexibility in strap adjustment can generally make the strap easier to take on and off and can also allow for easier adjustment when the armband is on.

According to another embodiment, the first wing structure and the second wing structure are made of a first material and the outer shell is made of a second material more rigid than the first material. By using a less rigid material for the first and second wing structures, it is ordinarily possible to allow for movement or bending of the first and second wing structures with respect to the outer shell. Such movement or bending can usually allow the electronic device holder to better fit a wide variety of different arm sizes.

According to yet another embodiment, a strap includes an inner layer for contacting an arm and an outer layer opposite the inner layer. The inner layer includes a moisture wicking material. This arrangement can ordinarily allow for improved absorption of sweat on the inside of the strap.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

DETAILED DESCRIPTION

In the following detailed description, numerous specific details are set forth to provide an understanding of the present disclosure. It will be apparent, however, to one of ordinary skill in the art that elements of the present disclosure may be practiced without some of these specific details. In other instances, well-known structures and techniques have not been shown in detail to avoid unnecessarily obscuring the present disclosure.

Figure 1:
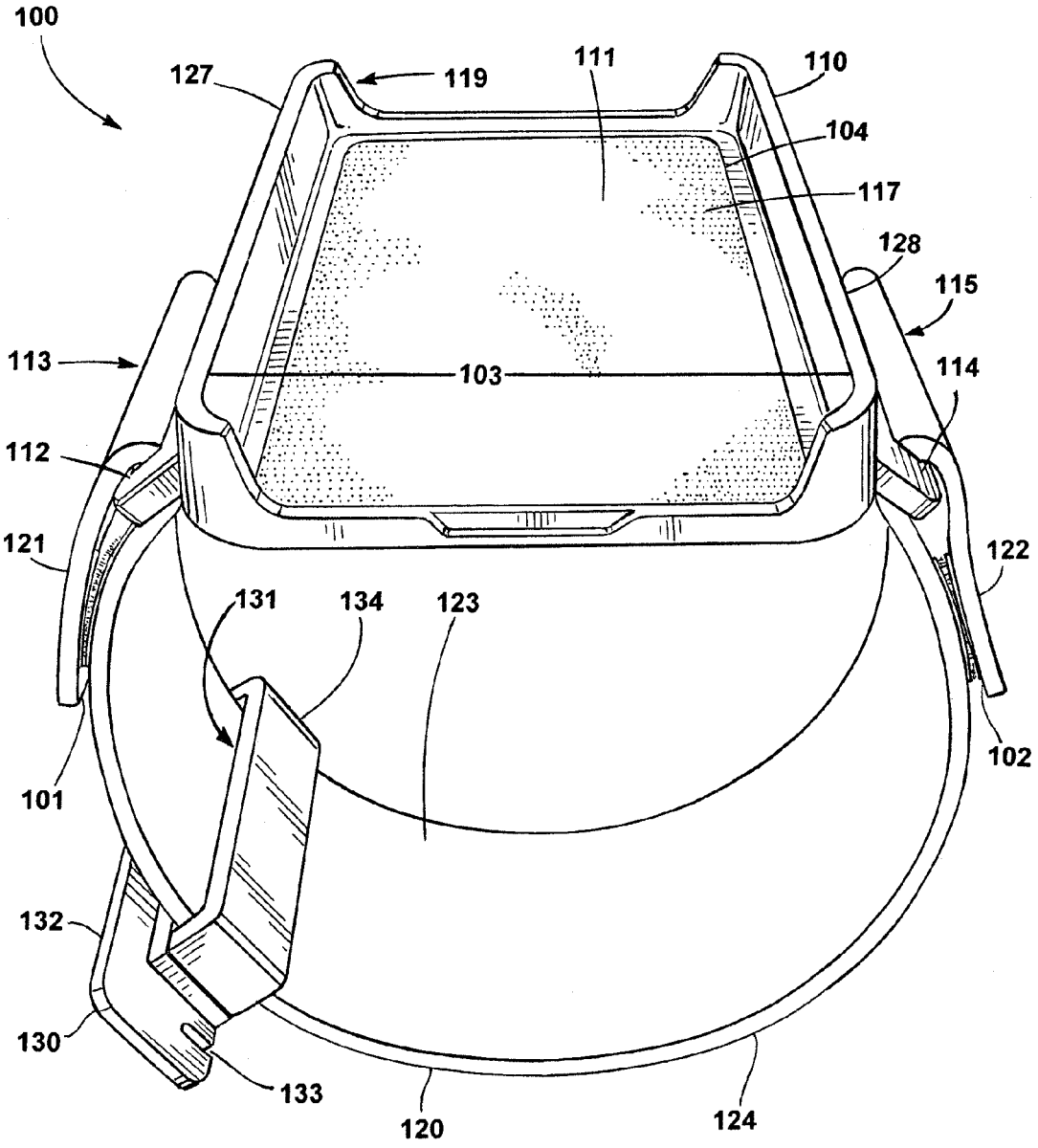
FIG. 1 is a front perspective view of an armband having an electronic device holder, a strap and a clip according to an embodiment.
Figure 2:
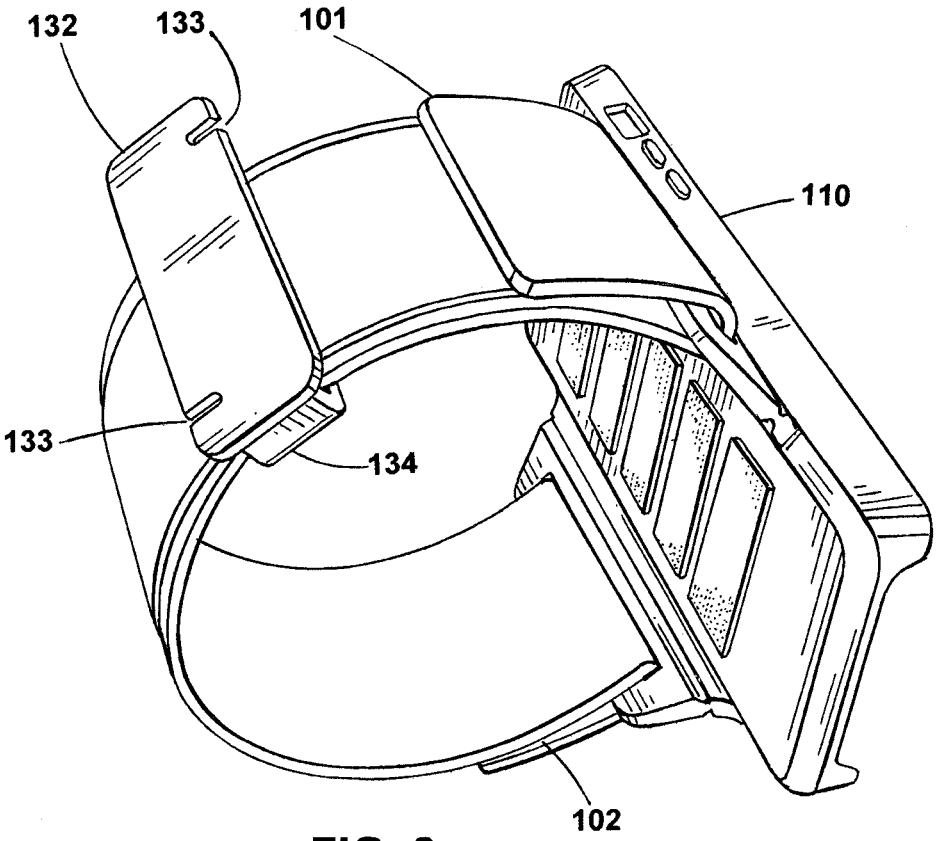
FIG. 2 is a rear perspective view of the armband of FIG. 1 according to an embodiment.
Figure 3:
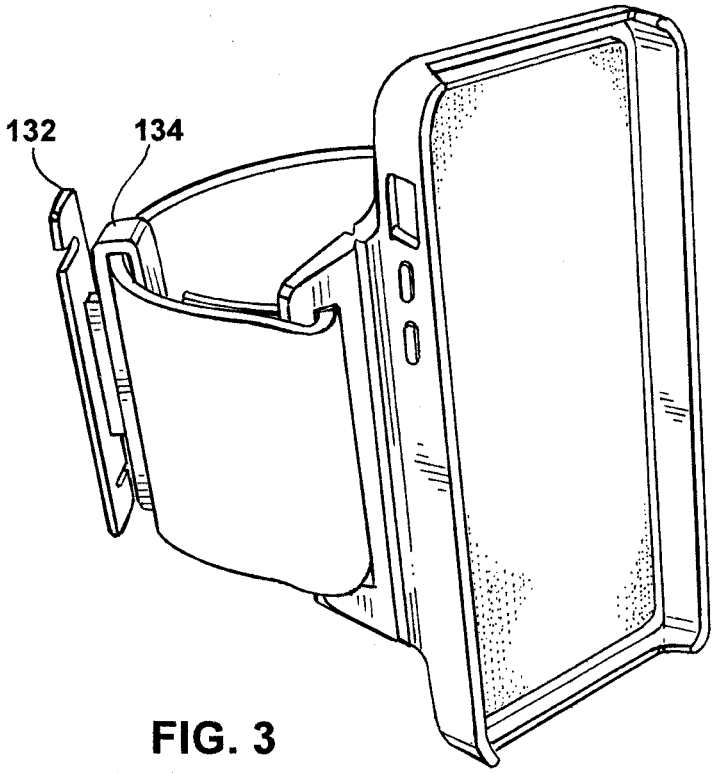
FIG. 3 is a side perspective view of the armband of FIGS. 1 and 2 according to an embodiment.

FIGS. 1-3 are perspective views of an armband 100 including an electronic device holder 110, a strap 120 and a clip 130 according to an embodiment. Referring to FIGS. 1-3, the electronic device holder 110 allows for insertion of an electronic device, such as a smartphone. The outer shell 119 of the electronic device holder 110 defines a cavity 111 for holding the electronic device and a shell opening 103 of the outer shell 119 is configured to receive the electronic device into the cavity 111. As shown in the examples of FIGS. 1-3, the outer shell 119 includes inwardly curving edges 127 and 128 at the shell opening 103 to secure the electronic device within the cavity 111.

In addition, a foam or cushioned material 117 is generally inserted into and/or glued onto a base surface 104 of the outer shell 119 to enhance the grip of the cavity 111 in holding an electronic device. The base surface 104 can be a planar surface such that the base surface 104 lies substantially within a base plane of the electronic device holder 110.

The electronic device holder 110 also includes a first wing structure 112 with a first strap opening 113 and a second wing structure 114 with a second strap opening 115. As shown in the examples of FIGS. 1-3, the first wing structure 112 extends from the outer shell 119 at a first angle to the shell opening 103 and the second wing structure 114 extends from the outer shell at a second angle to the shell opening. The first wing structure 112 and the second wing structure 114 extend outward from the outer shell 119 in downward directions outside of the base plane of base surface 104 with the second wing structure 114 extending from a portion of the outer shell 119 that is opposite the first wing structure 112.

In one implementation, the strap 120 has a first end portion 121 for insertion through the first strap opening 113 and a second end portion 122 for insertion through the second strap opening 115. The strap 120 also has an inner surface 123 for contacting the individual's arm and an outer surface 124.

First attachment portion 101 and second attachment portion 102 are located between the first end portion 121 and the second end portion 122 on the outer surface 124 for detachably securing the first end portion 121 and the second end portion 122 to the strap 120. Specifically, the first attachment portion 101 can detachably secure the first end portion 121 to the first attachment portion 101 after the strap 120 has passed through the first strap opening 113 to form a loop on one end of the strap 120. Similarly, the second attachment portion 102 can detachably secure the second end portion 122 to the second attachment portion 102 after the strap 120 has passed through the second strap opening 115 to form another loop on the other end of the strap 120. This arrangement can ordinarily allow for adjustment of the strap 120 at either end and can also make it easier to take the armband 100 on and off.

In other embodiments, the strap 120 may include only one attachment portion such that the attachment portion extends along a length of the outer surface 124. The attachment portions 101 and 102 can include, for example, Velcro or a clip for fastening the strap 120 on to itself.

As shown in the examples of FIGS. 1-3, the armband 100 also includes a clip 130 with a passageway 131 for allowing the strap 120 to pass through the passageway 131. The passageway 131 is formed between an inner member 134 and an outer member 132, which includes wire notches 133 that can be used to hold, for example, a wire for head phones. As shown in FIG. 2, the wire notches 133 can be arranged at opposite ends of the clip 130 to allow for different wire positions when held by a wire notch 133.

In an unlocked state where passageway 131 is not completely closed, the clip 130 is able to slide back and forth between the first end portion 121 of the strap 120 and the second end portion 122 of the strap 120 for proper adjustment and location positioning and for advantageously allowing a wire of the electronic device to properly and securely fit into a wire notch 133. When snapped in place into a locked state, the clip 130 can be fixed to the strap 120 so little to no movement is allowed along the strap 120. In one embodiment, the outer member 132 and the inner member 134 are hinged together on one end and a clasp is provided on the other end so that the clip 130 can be opened or closed. In the closed or locked state, the passageway 131 resists movement of the clip 130 along the strap 120.

Figure 4:
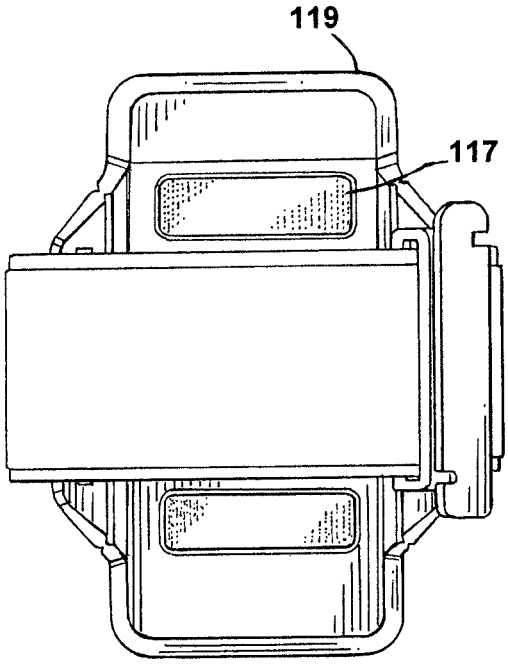
FIG. 4 is a rear view of an armband according to an embodiment.
Figure 5:
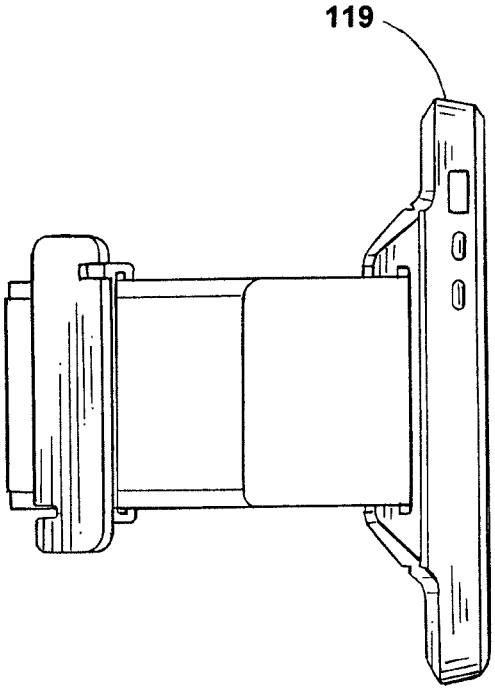
FIG. 5 is a left side view of the armband of FIG. 4 according to an embodiment.
Figure 6:
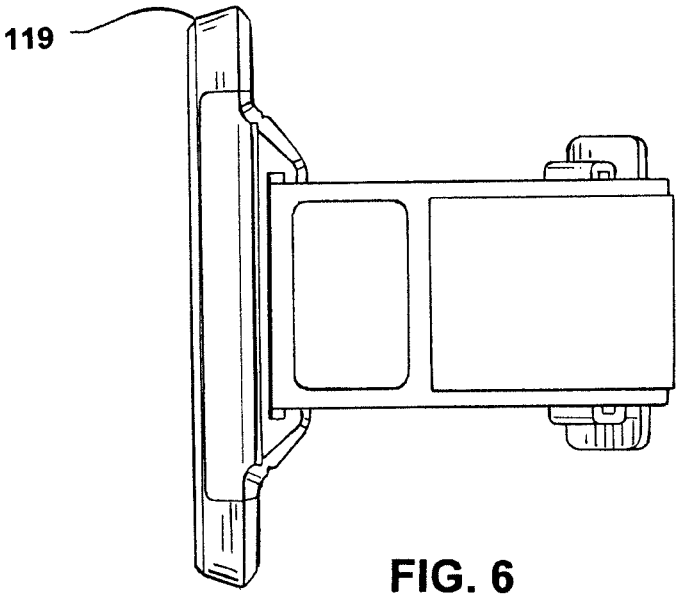
FIG. 6 is a right side view of the armband of FIGS. 4 and 5 according to an embodiment.
Figure 7:
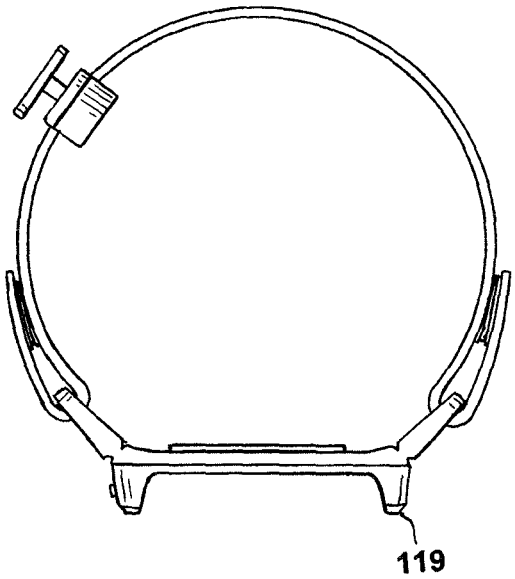
FIG. 7 is a top view of the armband of FIGS. 4 to 6 according to an embodiment.
Figure 8:
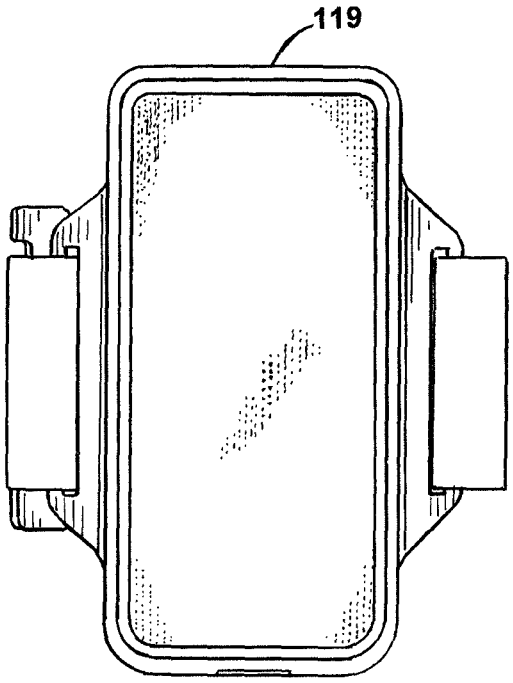
FIG. 8 is a front view of the armband of FIGS. 4 to 7 according to an embodiment.
Figure 9:
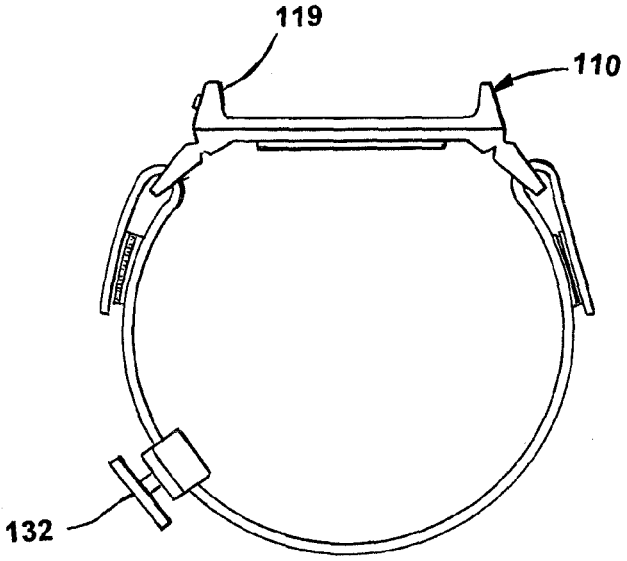
FIG. 9 is a bottom view of the armband of FIGS. 4 to 8 according to an embodiment.

FIGS. 4-9 are various views of the armband 100 of FIGS. 1-3 according to an embodiment. Referring to FIGS. 4-9, various views are shown and parts are described as exemplary features. As shown in FIG. 4, the foam or cushioned material 117 protrudes through openings in the outer shell 119. In other embodiments, the foam or cushioned material 117 may be affixed to the back of the outer shell 119. The foam or cushioned material 117 on the back side of the outer shell 119 can ordinarily provide a more comfortable fit on an arm and can help the electronic device holder 110 retain its position on the arm.

FIGS. 10-14 are various views of the electronic device holder 110 according to an embodiment. Referring to FIGS. 10-14, the electronic device holder 110 defines a cavity 111 for holding the electronic device. The first wing structure 112 and the second wing structure 114 can be made of a flexible, thermoplastic polyurethane (TPU) material so that the first and second wing structures 112 and 114 can bend or flex inward and outward about pivots 116 and 118 to advantageously allow for better comfort and fit on the individual's arm.

Figure 10:
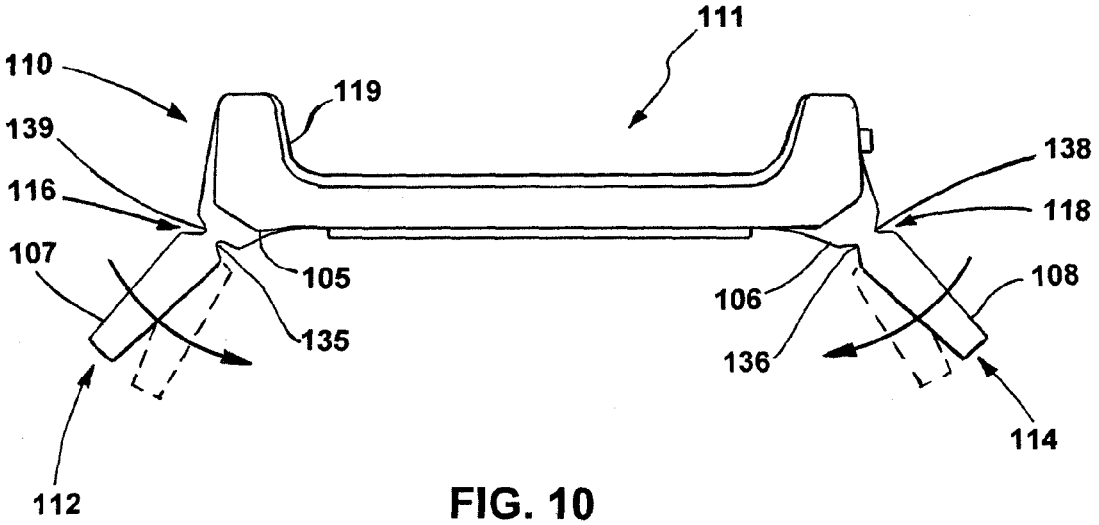
FIG. 10 is a top view of an electronic device holder according to an embodiment.
Figure 11:
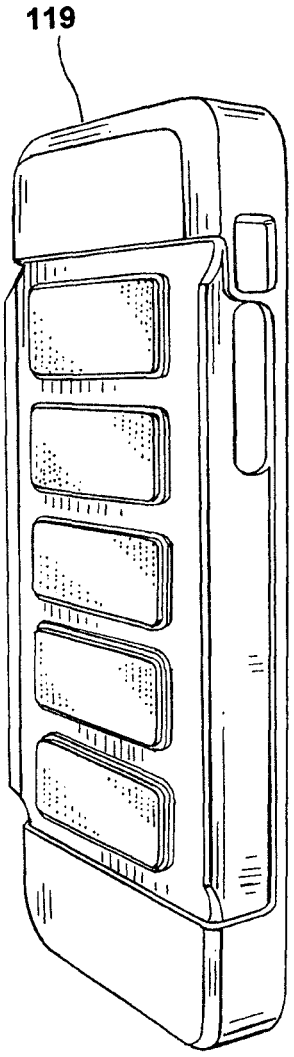
FIG. 11 is a rear view of an outer shell according to an embodiment.
Figure 12:
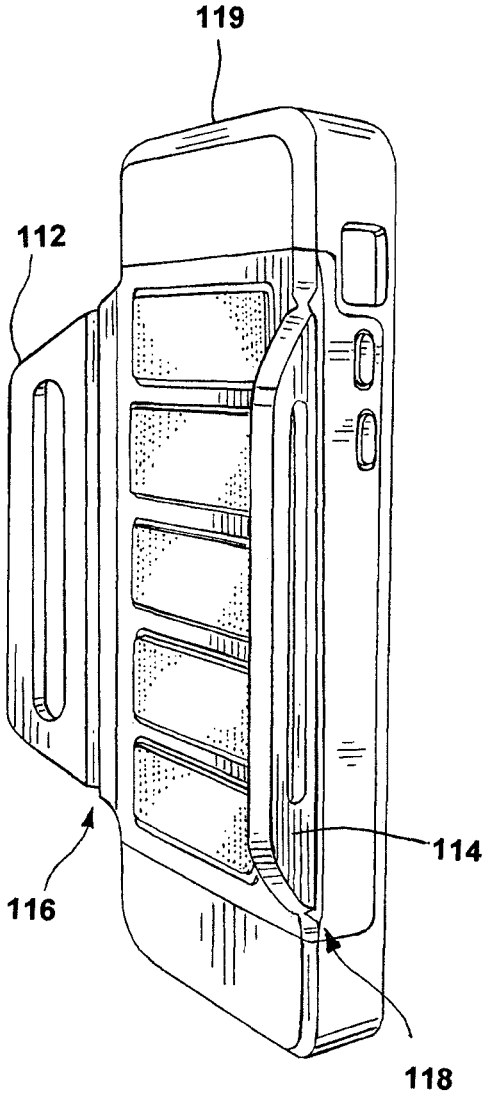
FIG. 12 is a rear view of an electronic device holder including the outer shell of FIG. 11 with a first wing structure and a second wing structure added to the outer shell according to an embodiment.
Figure 13:
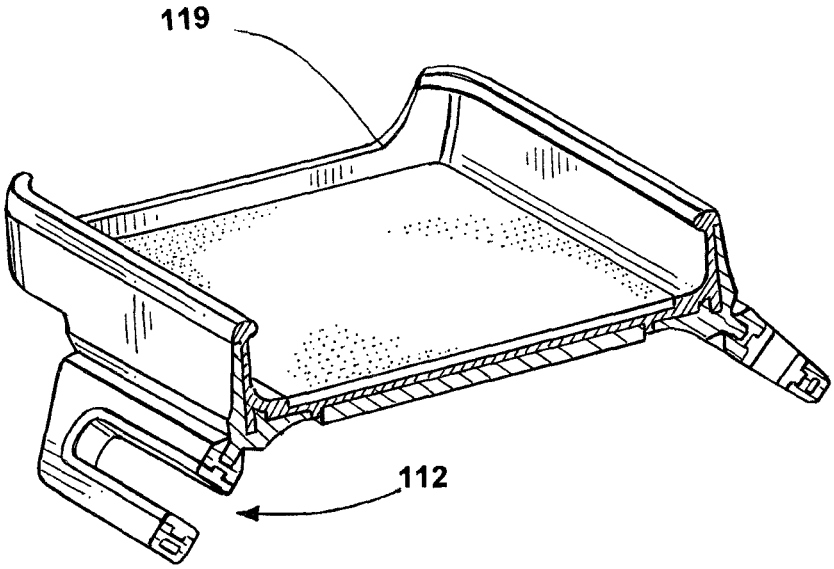
FIG. 13 is a partial top perspective view of an electronic device holder according to an embodiment.
Figure 14:
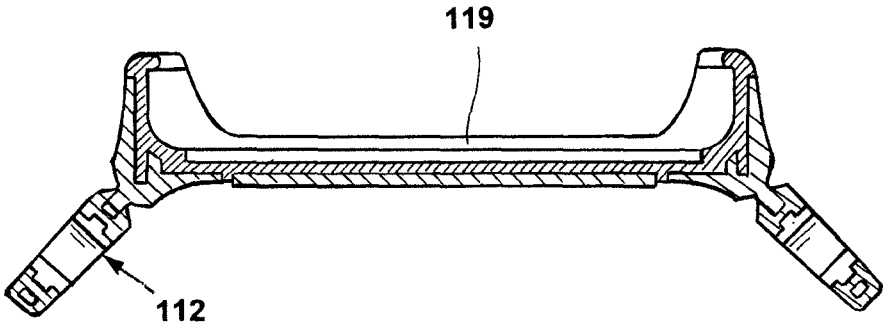
FIG. 14 is a partial front perspective view of the electronic device holder of FIG. 13 according to an embodiment.

As shown in the example of FIG. 10, the first wing structure 112 includes an upper portion 105 connected to the outer shell 119 and a lower portion 107 including the first strap opening 113. The first pivot 116 connects the upper portion 105 to the lower portion 107 and allows movement of the lower portion 107 with respect to the upper portion 105, as indicated in FIG. 10 with the arrow and dashed outline of the lower portion 107. Although only a downward movement of the lower portion 107 is shown in FIG. 10, an upward movement of the lower portion 107 is also possible. The first pivot 116 includes a top channel 139 formed in a top surface of the first wing structure 112 between the upper portion 105 and the lower portion 107. On a bottom surface of the first wing structure 112, the first pivot 116 includes a bottom channel 135 opposite the top channel 139.

Similar to the arrangement of the first wing structure 112, the second wing structure 114 in FIG. 10 includes an upper portion 106 connected to the outer shell 119 and a lower portion 108 including the second strap opening 115. The second pivot 118 connects the upper portion 106 to the lower portion 108 and allows movement of the lower portion 108 with respect to the upper portion 106. The second pivot 118 includes a top channel 138 formed in a top surface of the second wing structure 114 between the upper portion 106 and the lower portion 108. On a bottom surface of the second wing structure 114, the second pivot 118 includes a bottom channel 136 opposite the top channel 138. Each of the wing structures 112 and 114 can, for example, bend between 5 degrees and 25 degrees in both the inward and outward directions for better adjustment and comfort. In addition, the bending or movement of the first wing structure 112 and the second wing structure 114 can allow the armband 100 to fit a wider variety of different arm sizes.

In other embodiments, pivots 116 and 118 may include hinges. In yet other embodiments, the entire first and second wing structures 112 and 114 may be movable about pivots located at the outer shell 119 to allow the entire first and second wing structures 112 and 114 to move inward and outward.

The outer shell 119 of the electronic device holder 110 can be made of a more rigid polycarbonate (PC) material to keep the electronic device secure while also allowing slight flexibility to take the electronic device into and out of the cavity 111. In one implementation, the rigid PC material is injected into the mold and then the flexible TPU material is injected to form the first and second wing structures 112 and 114. This combination of materials advantageously allows for the electronic device holder 110 to be flexible for better comfort and fit, while still allowing for rigidity to securely hold the electronic device.

Without providing for different angles of the wing structures 112 and 114 with pivots 116 and 118 or the combination of different materials, a gap may form between the case and a smaller arm or the electronic device holder 110 may pinch into a larger arm. The movement of the wing structures 112 and 114 in relation to the outer shell 119 typically allows for a better fit of the electronic device holder 110 to a wider variety of arm sizes.

In other embodiments, the outer shell 119 and the first and second wing structures 112 and 114 can be made of the same material, such as a flexible TPU material or a more rigid PC material. Constructing the electronic device holder 110 of a single material can allow for cost savings in manufacturing, but may involve producing different sized electronic device holders (e.g., large and small sizes) to fit different sized arms. With such embodiments, different sized wing structures may be provided to fit different sized arms with larger wing structures for larger arms and smaller wing structures for smaller arms. In addition, the angles at which the first and second wing structures 112 and 114 extend from the outer shell 119 can vary based on the size of the wing structure. Without providing for different angles of the wing structures, a gap may form between a smaller arm and the electronic device holder 110 or the electronic device holder 110 may pinch or cut into a larger arm.

Figure 15:
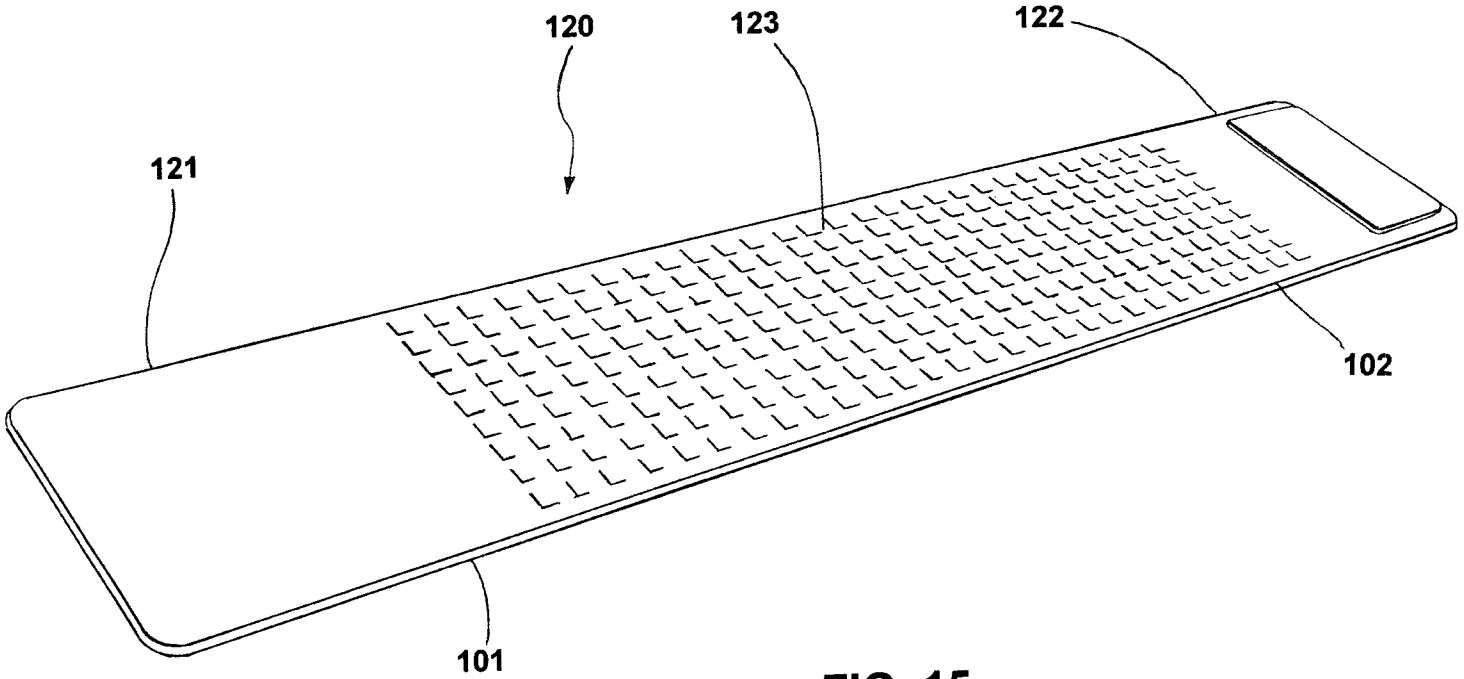
FIG. 15 is a perspective view of a strap according to an embodiment.
Figure 16:
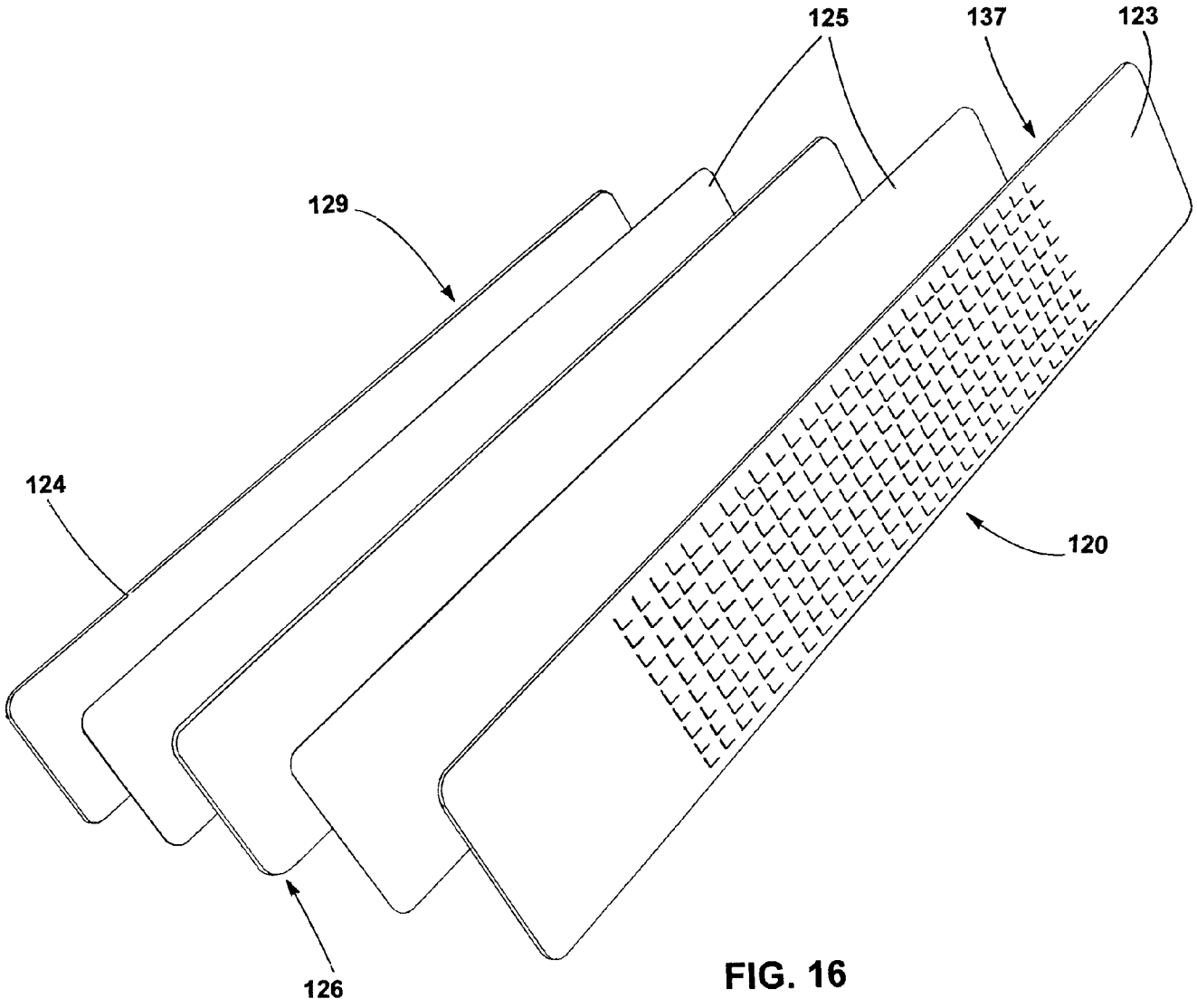
FIG. 16 is an exploded view of the strap of FIG. 15 according to an embodiment.

FIGS. 15 and 16 are various views of the strap 120 according to an embodiment. FIG. 15 shows the inner surface 123 of the strap 120 for contacting the individual's arm. The exterior of inner surface 123 has square patterned protrusions for enhanced gripping to the individual's arm. In addition, the pattern of protrusions forms channels between the protrusions for allowing moisture to exit an inner layer 137 of the strap 120.

FIG. 16 shows the multiple layers used to make the strap 120 according to an embodiment. As shown in the example of FIG. 16, the inner layer 137 includes a moisture wicking material or fabric that allows for absorption wicking. Such a wicking material can, for example, include a blend of coconut fiber and polyester with approximately 40% coconut fiber and 60% polyester. This construction of the strap 120 can ordinarily allow for improved moisture control in the strap 120. In addition, the material of the inner layer 137 can be treated with an antibacterial and/or odor resistant coating.

As shown in the examples of FIGS. 15 and 16, the inner surface 123 includes a pattern of square protrusions for enhanced gripping to the individual's arm and for sweat and other moisture to exit the surface due to the channels formed between the square protrusions. In other embodiments, a different pattern of protrusions or differently shaped protrusions, such as a rectangular or triangular, may be used on inner surface 123.

A foam material or layer 126 is inserted between the inner layer 137 and the outer layer 129 to provide additional strength and cushioning of the strap 120. In the example of FIG. 16, the foam material or layer 126 is heat pressed in between the inner layer 137 and the outer layer 129 using heat press glue sheets 125.

The outer layer 129 of the strap 120 may include a moisture wicking material. In some implementations, the inner layer 137 may be made of the same material as the outer layer 129.

In other embodiments, the outer layer 129 can include a water repellant material such as polyester that has been treated with a water resistant coating. By providing a water repellant material in the outer layer 129, it is ordinarily possible to resist the absorption of moisture (e.g., sweat or rain) on the outer surface 124 while still wicking moisture on the inner surface 123.

In yet other embodiments, the outer layer 129 can include an ultraviolet (UV) radiation resistant material that is resistant to changes in the material caused by UV radiation. In some implementations, the same material in outer layer 129 can provide both water repellant and UV resistant properties. The UV radiation resistant material can include, for example, polyester treated with a UV resistant coating. By providing a UV radiation resistant material in the outer layer 129, it is ordinarily possible to slow the aging, breakdown, or fading of the strap 120.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. An armband, comprising:

an electronic device holder made of a first material, the electronic device holder including an outer shell defining a cavity for holding an electronic device, the outer shell having a back side configured to contact a user's arm, the back side having two lengthwise edges and two widthwise edges;

a first wing structure made of a second material less rigid than the first material, the first wing structure having a top surface and a bottom surface, and including an upper portion connected to the outer shell at a first lengthwise edge of the back side, a lower portion including a first strap opening, and a first pivot connecting the upper portion of the first wing structure to the lower portion of the first wing structure and allowing for movement of the lower portion relative to the upper portion, the first pivot including a top channel formed in the top surface of the first wing structure between the upper portion and the lower portion and a bottom channel opposite the top channel, formed in the bottom surface of the first wing structure between the upper portion and the lower portion;

a second wing structure made of the second material, the second wing structure having a top surface and a bottom surface, and including an upper portion connected to the outer shell at a second lengthwise edge of the back side opposite the first lengthwise edge of the back side, a lower portion including a second strap opening, and a second pivot connect in the upper portion of the second wing structure to the lower portion of the second wing structure and allowing for movement of the lower portion relative to the upper portion, the second pivot including a top channel formed in the top surface of the second wing structure between the upper portion and the lower portion and a bottom channel opposite the top channel, formed in the bottom surface of the second wing structure between the upper portion and the lower portion;

a plurality of cushions located on the back side of the outer shell between the first wing structure and the second wing structure and configured to provide a comfortable fit against the user's arm, the plurality of cushions being rectangularly shaped arranged parallel to the two widthwise edges of the back side, the plurality of cushions being elevated from the back side of the outer shell and spaced apart such that a plurality of horizontal channels are located between the plurality of cushions, and the plurality of cushions being spaced away from the first wing structure and the second wing structure such that a first vertical channel is located between the plurality of cushions and the first wing structure and a second vertical channel is located between the plurality of cushions and the second wing structure; and a strap including a first end portion for insertion into the first strap opening, a second end portion opposite the first end portion, and at least one attachment portion located between the first end portion and the second end portion for detachably securing the first end portion to the at least one attachment portion after the strap has passed through the first strap opening and for detachably securing the second end portion to the at least one attachment portion after the strap has passed through the second strap opening.

2. The armband of claim 1, wherein the outer shell includes a shell opening configured to receive the electronic device, and wherein the first wing structure extends outward from the outer shell at a first angle to the shell opening and the second wing structure extends outward from the outer shell at a second angle to the shell opening.

3. The armband of claim 1, wherein the outer shell includes at least two inwardly curved edges configured to secure the electronic device within the cavity.

4. The armband of claim 1, wherein the strap further includes:

an inner layer for contacting an arm, the inner layer including a moisture wicking material; and an outer layer opposite the inner layer, the outer layer including a water repellant material.

5. The armband of claim 1, further comprising a clip secured onto the strap, the clip including at least one notch for holding a wire.

6. The armband of claim 5, wherein the clip includes a passageway to allow the strap to pass through the clip, and wherein the passageway is configured to allow the clip to slide along the strap in an unlocked state and to resist movement of the clip along the strap in a locked state.

7. An electronic device holder for an armband, the electronic device holder comprising:

an outer shell made of a first material and defining a cavity for insertion of an electronic device, the cavity including a base surface substantially within a base plane, the outer shell having a back side configured to contact a user's arm, the back side having two lengthwise edges and two widthwise edges;

a first wing structure made of a second material less rigid than the first material and extending from the outer shell in a first direction outside of the base plane, the first wing structure having a top surface and a bottom surface, and including an upper portion connected to the outer shell at a first lengthwise edge of the back side, a lower portion including a first strap opening for a strap to fit through the first strap opening, and a first pivot connecting the upper portion of the first wing structure to the lower portion of the first wing structure and allowing for movement of the lower portion relative to the upper portion, the first pivot including a top channel formed in the top surface of the first wing structure and a bottom channel opposite the top channel, formed in the bottom surface of the first wing structure; and a second wing structure made of the second material and extending from the outer shell in a second direction outside of the base plane, the second wing structure having a top surface and a bottom surface, and including an upper portion connected to the outer shell at a second lengthwise edge of the back side opposite the first lengthwise edge of the back side, a lower portion including a second strap opening for the strap to fit through the second strap opening, and a second pivot connecting the upper of the second wing structure to the lower portion of the second wing structure and allowing for movement of the lower portion relative to the upper portion, the second pivot including atop channel formed in the top surface of the second wing structure, and a bottom channel opposite the top channel, formed in the bottom surface of the second wing structure; and a plurality of cushions located on the back side of the outer shell between the first wing structure and the second wing structure and configured to provide a comfortable fit against the user's arm, the plurality of cushions being rectangularly shaped and arranged parallel to the two widthwise edges of the back side the plurality of cushions being elevated from the back side of the outer shell and spaced apart such that a plurality of horizontal channels are located between the plurality of cushions, and the plurality of cushions being spaced away from the first wing structure and the second wing structure such that a first vertical channel is located between the plurality of cushions and the first wing structure and a second vertical channel is located between the plurality of cushions and the second wing structure.

8. The electronic device holder of claim 7, wherein the second material is flexible so as to allow bending of the first wing structure and the second wing structure when the electronic device holder is secured to an arm by the strap.

9. An armband, comprising:

an electronic device holder made of a first material, the electronic device holder including an outer shell defining a cavity for holding an electronic device, the outer shell having a back side configured to contact a user's arm, the back side having two lengthwise edges and two widthwise edges;

a first wing structure made of a second material less rigid than the first material, the first wing structure extending from a first lengthwise edge of the back side, and having a first pivot allowing for movement of the first wing structure relative to the electronic device holder, the first pivot including a top channel parallel to the first lengthwise edge and formed in a top surface of the first wing structure, and a bottom channel opposite the top channel, parallel to the first lengthwise edge, and formed in a bottom surface of the first wing structure, the bottom surface of the first wing structure configured to contact the user's arm;

a second wing structure made of the second material, the second wing structure extending from a second lengthwise edge of the back side opposite the first lengthwise edge of the back side, and having a second pivot allowing for movement of the second wing structure relative to the electronic device holder, the second pivot including a top channel parallel to the second lengthwise edge and formed in a top surface of the second wing structure, and a bottom channel opposite the top channel, parallel to the second lengthwise edge, and formed in a bottom surface of the second wing structure, the bottom surface of the second wing structure configured to contact the user's arm;

a plurality of cushions located on the back side of the outer shell between the first wing structure and the second wing structure and configured to provide a comfortable fit against the user's arm, the plurality of cushions being rectangularly shaped and arranged parallel to the two widthwise edges of the back side, the plurality of cushions being elevated from the back side of the outer shell and spaced apart such that a plurality of horizontal channels are located between the plurality of cushions, and the plurality of cushions being spaced away from the first wing structure and the second wing structure such that a first vertical channel is located between the plurality of cushions and the first wing structure and a second vertical channel is located between the plurality of cushions and the second wing structure; and a strap including a first attachment portion, a second attachment portion, a first end portion configured to be inserted into the first strap opening and removably attached to the first attachment portion such that a tightness of the strap on the user's arm may be adjusted, and a second end portion on an opposite end of the strap from the first end portion, the second end portion configured to be inserted into the second strap opening and removably attached to the second attachment portion such that the tightness of the strap on the user's arm may be adjusted.

10. The armband of claim 9, further comprising a clip secured onto the strap, the clip including at least one notch for holding a wire.

11. The armband of claim 10, wherein the clip includes a passageway to allow the strap to pass through the clip, and wherein the passageway is configured to allow the clip to slide along the strap in an unlocked state and to resist movement of the clip along the strap in a locked state.

12. The armband of claim 9, wherein the strap further comprises:

an inner layer for contacting an arm, the inner layer including a moisture wicking material; and an outer layer opposite the inner layer, the outer layer having the first attachment portion and the second attachment portion.

13. The armband of claim 12, wherein the outer layer includes a water repellant material.

14. The armband of claim 12, wherein the outer layer includes a moisture wicking material.

15. The armband of claim 12, wherein the outer layer includes an ultraviolet (UV) radiation resistant material that is resistant to changes in the material that are caused by UV radiation.

16. The armband of claim 12, further comprising a foam layer between the inner layer and the outer layer.

17. The armband of claim 12, wherein the inner layer includes an exterior pattern of square-shaped protrusions forming channels between the protrusions for allowing moisture to exit the inner layer.

* * * * *